US007370520B2

(12) United States Patent
Kortsen

(10) Patent No.: US 7,370,520 B2
(45) Date of Patent: May 13, 2008

(54) METHOD OF TESTING A FUEL INJECTION VALVE FOR A DIESEL ENGINE

(75) Inventor: Bent Kortsen, Hellerup (DK)

(73) Assignee: IB Obel Pedersen A/S, Brondby (DK)

( * ) Notice: Subject to any disclaimer, the term of this patent is extended or adjusted under 35 U.S.C. 154(b) by 132 days.

(21) Appl. No.: 10/576,516

(22) PCT Filed: Oct. 18, 2004

(86) PCT No.: PCT/DK2004/000711

§ 371 (c)(1),
(2), (4) Date: Apr. 20, 2006

(87) PCT Pub. No.: WO2005/038239

PCT Pub. Date: Apr. 28, 2005

(65) Prior Publication Data

US 2007/0157716 A1 Jul. 12, 2007

(30) Foreign Application Priority Data

Oct. 20, 2003 (DK) ..... 2003 01534

(51) Int. Cl.
*F02M 65/00* (2006.01)

(52) U.S. Cl. ..... 73/119 A

(58) Field of Classification Search ..... 73/49.7, 73/116, 117.2, 117.3, 118.1, 119 A, 119 R
See application file for complete search history.

(56) References Cited

U.S. PATENT DOCUMENTS 3,874,225 A * 4/1975 Fegel ..... 73/40
4,088,012 A * 5/1978 Emerson ..... 73/119 A
4,569,227 A * 2/1986 Adolph ..... 73/119 A
4,788,858 A * 12/1988 Liebermann ..... 73/119 A
5,195,362 A * 3/1993 Eason ..... 73/49.7
5,906,190 A * 5/1999 Hole et al. ..... 123/531

FOREIGN PATENT DOCUMENTS

| | | | |
|---|---|---|---|
| DE | 33 15 503 | C1 | 5/1984 |
| DE | 197 26 746 | A1 | 1/1999 |
| DE | 198 01 640 | C1 | 4/1999 |
| GB | 910894 | A | 11/1962 |
| JP | 60-187758 | A | 9/1985 |
| WO | WO 02/079639 | A1 | 10/2002 |

* cited by examiner

*Primary Examiner*—Eric S. McCall
(74) *Attorney, Agent, or Firm*—McDermott Will & Emery LLP

(57) ABSTRACT

Method of testing a fuel injection valve 1 for a diesel engine by supplying pressurized oil to the inlet side of the valve. According to the invention the oil pressure is gradually recorded, the pressure increase being interrupted at the moment when the opening pressure of the valve is exceeded, which is noted by a drop in the pressure on the inlet side. At the same time the opening pressure is recorded. As a result a more lenient test method is provided, which also can be used in connection with newly developed injection valves.

1 Claim, 5 Drawing Sheets

METHOD OF TESTING A FUEL INJECTION VALVE FOR A DIESEL ENGINE

RELATED APPLICATIONS

This application is the U.S. National Phase under 35 U.S.C. § 371 of International Application No. PCT/DK2004/000711, filed on Oct. 18, 2004, which in turn claims the benefit of Danish Application No. PA 2003 01534, filed on Oct. 20, 2003, the disclosures of which Applications are incorporated by reference herein.

TECHNICAL FIELD

The invention relates to a method for testing a valve, especially a comparatively large fuel injection valve for a comparatively large diesel engine by supplying pressurized test oil to the inlet side of the valve, by which method the oil pressure on the inlet side gradually increases while being recorded.

BACKGROUND ART

MAN B & W DIESEL A/S has recently developed a new type of fuel injection valves named "slide fuel valves" of the types K 90 MC-C and K 80 MC-C, etc, confer FIG. 2. Compared to conventional valves, confer FIG. 1, a void in the valve tip called the "sac volume" or clearance volume has been eliminated, thereby preventing an untimely injection of a small volume of fuel corresponding to the clearance volume (typically 1-2 $cm^3$). This has resulted in a reduced sooting of the diesel engine, reduced smoke generation, lower $NO_x$ and VOC emissions and not least improved fuel efficiency.

The fuel injection valve should be checked on a regular basis inter alia to ensure that inter alia the opening pressure is correct. The opening pressure may for instance have changed due to slackness in a built-in spring in the valve. Furthermore the venting pressure is checked and a "carburetion test" may also be carried out. The conventional equipment for checking fuel valves, including the opening pressure, the venting pressure, and the carburetion test operates in the following manner. Compressed air (5-10 bar) is supplied to a pneumatic pump, which converts the air pressure to a hydraulic oil pressure of several hundred bar. All tests are performed by feeding pure test oil to the valve at specific pressures, whereby it is possible to test that the various parts of the valve function correctly. At the opening pressure test the pressure in the valve is gradually increased until a built-in slide body in the valve is activated and the valve is opened briefly, whereafter the pressure drops slightly and the slide body recloses until the pressure once again exceeds the opening pressure. In the carburetion test an internal oil pressure is generated in the pump, said pressure exceeding the opening pressure of the valve considerably. When the connection between the pump and the injection valve is established, usually by pulling a large lever, confer FIG. 7, the valve immediately begins to rattle until the connection between the injection valve and the pump is cut off. This conventional test equipment has, however, a disadvantageous influence on the functionality of the new valves. The new valves with a built-in slide body in the valve tip do not tolerate being subjected to the conventional carburetion test and they are subjected to unnecessary stress by being subjected to the normal opening test with several successive openings. The reason why the valves with slide bodies break when the carburetion test (and/or a too thorough execution of the opening pressure test) is performed is presumably that defects arise on the valves due to the differing physico-chemical properties of the test oil and of the normal diesel oil. In addition hereto, metals expand when heated. Other things being equal, the outer face of the valve tip is hotter than the metallic slide body situated inside the valve, which means that the friction resistance therebetween is higher during testing than during normal operation.

DESCRIPTION OF THE INVENTION

The object of the invention is thus to provide a more lenient test method, which also can be used in connection with the newly developed injection valves.

A method of the above type is according to the invention characterised in that the pressure increase is electronically momentarily interrupted when the opening pressure of the valve is exceeded, corresponding to the pressure on the inlet side dropping, a compressed air supply for providing the oil pressure on the inlet side being momentarily electronically interrupted at that moment, whereafter inter alia the opening pressure is used to decide whether the injection angle in its present state is suitable for use in the engine.

At the moment when the pressure drops due to the opening of the fuel valve, the electronic unit ensures that the supply of compressed air to the pump is shut off by activating a magnetic valve in the compressed air pipe. The pump thus stops and the opening pressure of the injection valve is frozen on a display. The combination of an electronic measurement, a magnetic valve and digital reading also ensures that unlike before the opening pressure is only maintained for a few ms.

As a result, the test is able to reveal defects in the injection valve without causing damage thereof.

BRIEF DESCRIPTION OF THE DRAWINGS

The invention is explained in greater detail below with reference to the accompanying drawings, in which.

BEST MODE(S) FOR CARRYING OUT THE INVENTION

Figure 1:
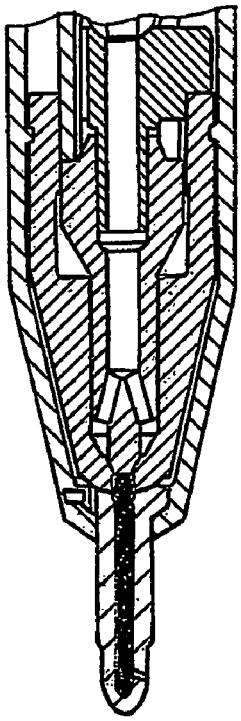
FIG. 1 shows a conventional fuel injection valve with clearance volume.
Figure 2:
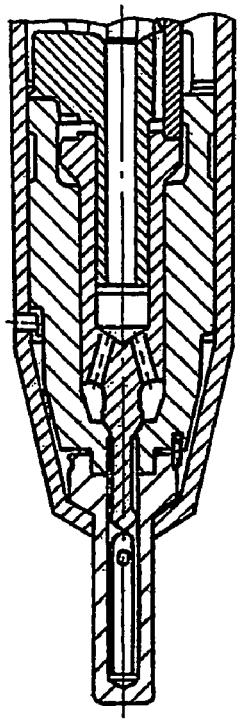
FIG. 2 shows one of the newly developed fuel valves comprising a slide body for filling the clearance volume.
Figure 3:
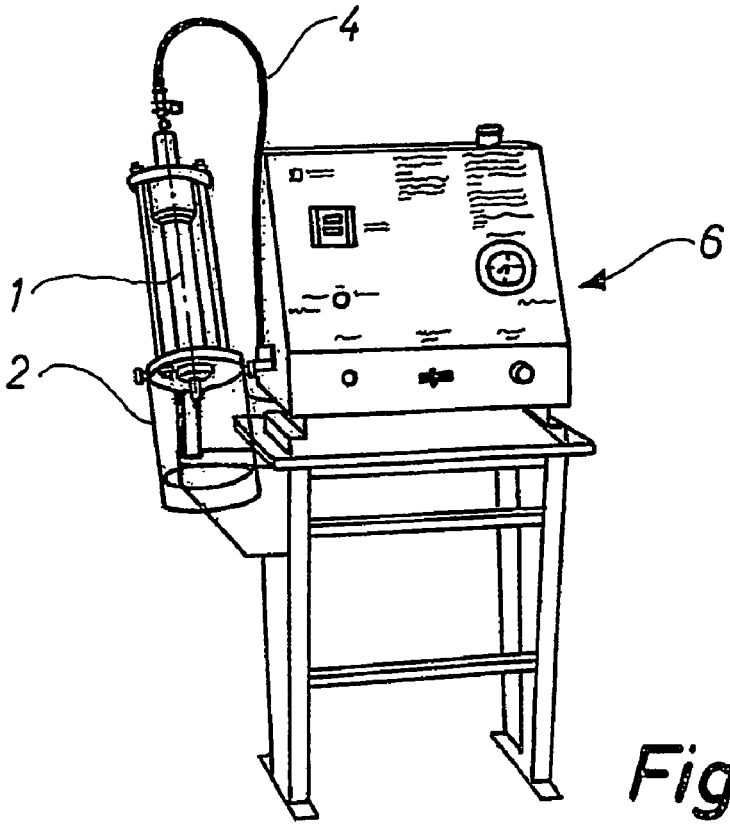
FIG. 3 shows equipment according to the invention for testing the new fuel injection valves.

The equipment shown in FIG. 3 for testing one of the new fuel injection valves 1 (confer FIG. 2), which does not tolerate being subjected to a manual opening pressure test and the above mentioned carburetion test, includes an oil collection tank 2, in which the tip of the injection valve is inserted. A hose 4 has been led to the inlet side of the valve for supplying pressurized test oil. The hose 4 is led from a measuring device 6 including a pneumatically operated hydraulic pump (oil pump). A clear and thin oil is used as test oil, said oil not being as viscous as the oil used during normal operation of a diesel engine.

Figure 5:
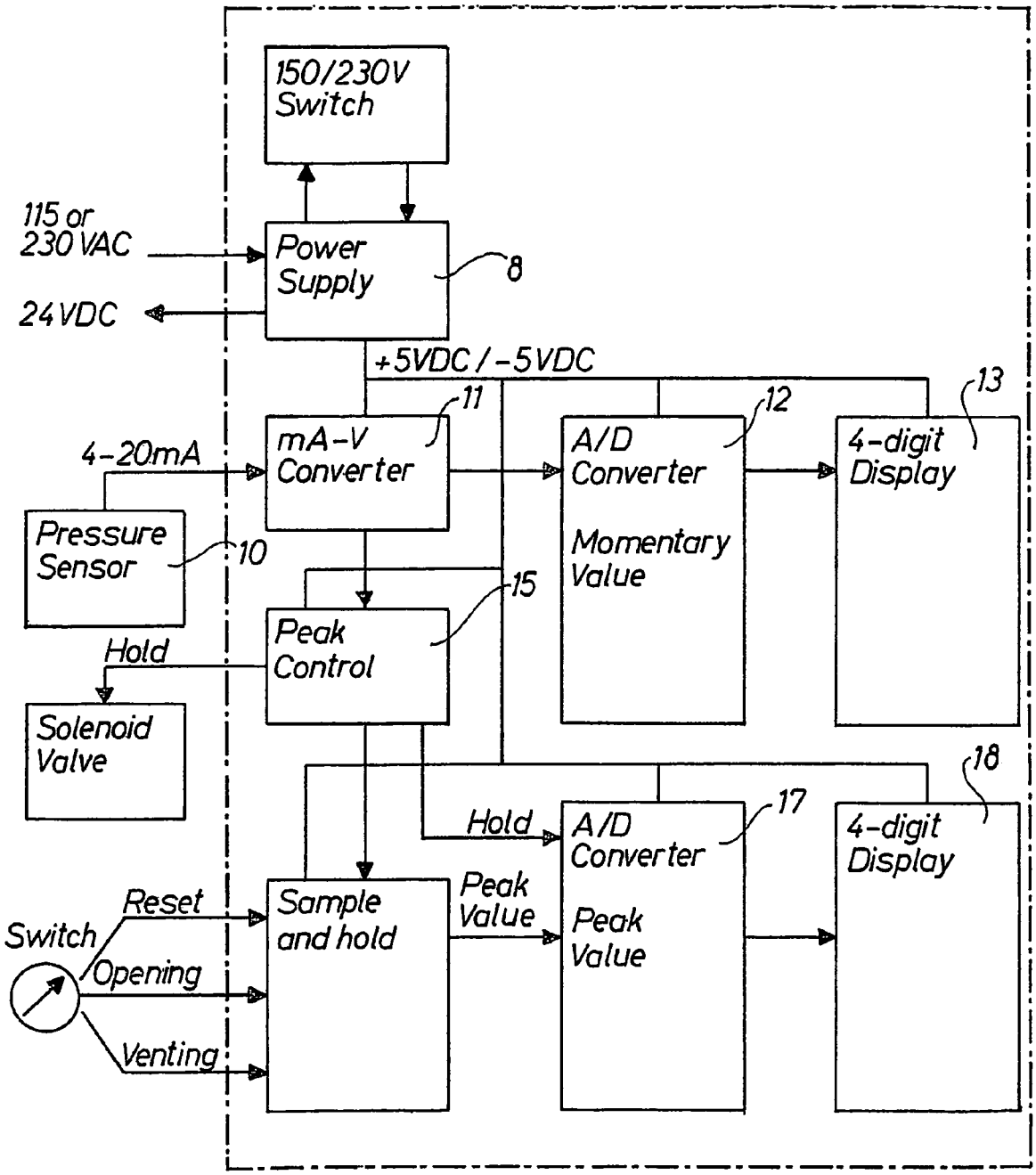
FIG. 5 is an electric diagram of the equipment shown in FIG. 3 and the adapter shown in FIG. 4.

FIG. 5 is a flow chart of the measuring device 6. It comprises a power supply 8 which is supplied with mains voltage and converts this mains voltage to a low voltage of ±5 VDC. The low voltage is used to operate various units which will be described below.

Outside the large box which is shown by means of dotted lines a pressure sensor 10 is provided reading the oil pressure on the inlet side of the injection valve. The pressure sensor 10 emits a current of 4-20 mA depending on the pressure. The current is fed to a mAN converter converting the current to a voltage level. The voltage level is transmitted to an A/D converter 12, which converts the voltage level to a digital value to be displayed in a subsequent digital display 13.

The voltage level from the mA/V converter 11 is also transmitted to a peak value control 15. The peak value control 15 reads the maximum value of the peak value of the voltage level at the moment when the voltage level begins to decrease and transmits this voltage level to an A/D converter 17 converting the value to a digital value to be displayed in a subsequent digital display 18.

Figure 6:
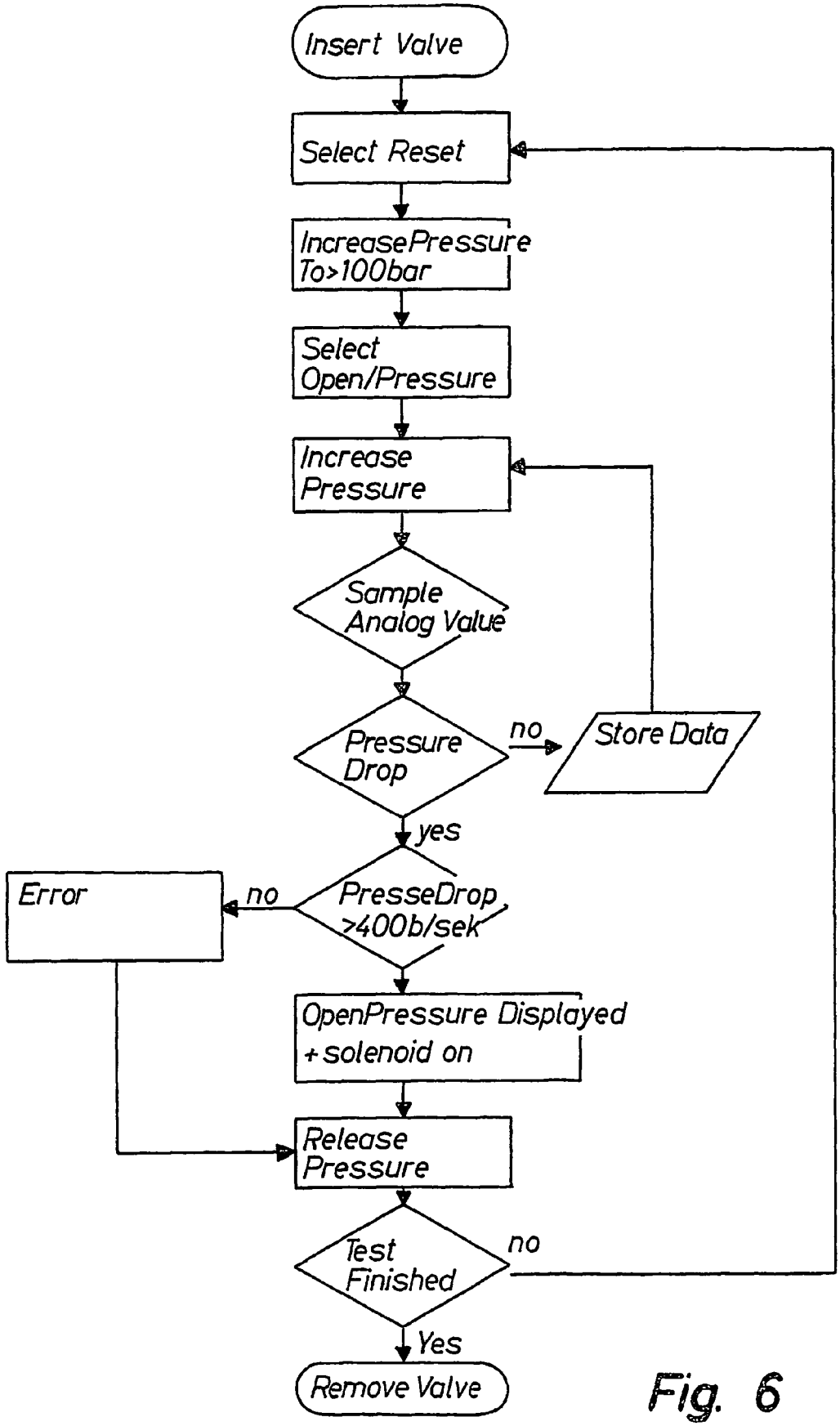
FIG. 6 illustrates how the equipment according to the invention operates.

FIG. 6 is a flow chart of the single test. Initially the tip of the injection valve is inserted into the oil collection tank 2. Then the pressure is increased to exceed 100 bar and the opening pressure is selected. The pressure is subsequently further increased and the value of the pressure is sampled. If the drop in pressure exceeds 400 bar/sec., the opening of the valve slide occurs as expected, and the valve is accepted, if the resulting opening pressure is correct. However, if the drop in pressure is below 400 bar/sec., the opening does not occur as expected, which results in an error.

The test may for instance take place as follows. Initially the venting pressure is measured, ie the pressure at which a reflux valve in the injection valve for flow of oil in the injection valve is closed. The venting pressure is typically 30 bar, but varies according to the valve type. In connection with this measurement, the pressure is increased to an initial pressure of for instance 150 bar. The initial pressure merely has to be considerably higher than the expected value of about 30 bar. The expected value is stated in the technical manual for the valve 1. The pressure is then decreased until a sudden pressure drop occurs corresponding to the opening of the reflux valve. The pressure at which the pressure drop occurred is recorded and compared to the desired value of about 30 bar. At a substantial deviation, the valve cannot be used, until it has been cleaned/repaired.

The opening pressure is then measured. In order for the injection valve to operate correctly, the opening pressure has to be of about 500 bar±25 bar in a hypothetical case. Also in this instance the expected opening pressure is mentioned in the technical manual for the valve. Tests by means of the test equipment demonstrate whether the valve complies with the guidelines stated in the technical manual from the valve supplier. A clear thin oil is used for measuring the opening pressure and for checking the reflux valve. The measuring is performed by gradually increasing the pressure until it drops. The pressure at which the drop occurred is recorded as the opening pressure. If the opening pressure is not satisfactory, the valve is to be adjusted or renovated. Usually a deviation implies that that the opening pressure is too low. This indicates that a built-in spring in the injection valve has become too slack, and an additional spacer may for instance be inserted in MAN B&W's valves so as to compensate therefor. Other valve suppliers have other ways of adjustment. The equipment may, however, also be used in connection with other valves than the valves from B&W. Other valves may optionally be adjusted by means of a screw.

If the opening pressure is not satisfactory, the valve 1 is to be adjusted or renovated. A satisfactory opening pressure does, however, not imply that the valve 1 is acceptable. The valve 1 is not accepted until all tests have been performed satisfactorily.

If some of the performed tests are not completed with the expected result, the crew onboard a ship has experience in disassembling the valves and cleaning/adjusting them. After cleaning/adjustment all tests are performed again. If problems still arise, the valve has to be renovated in a certified repair shop or discarded.

After each test the device is set to a so-called RESET position with a view to resetting. Resetting is necessary after each performed test.

Figure 4:
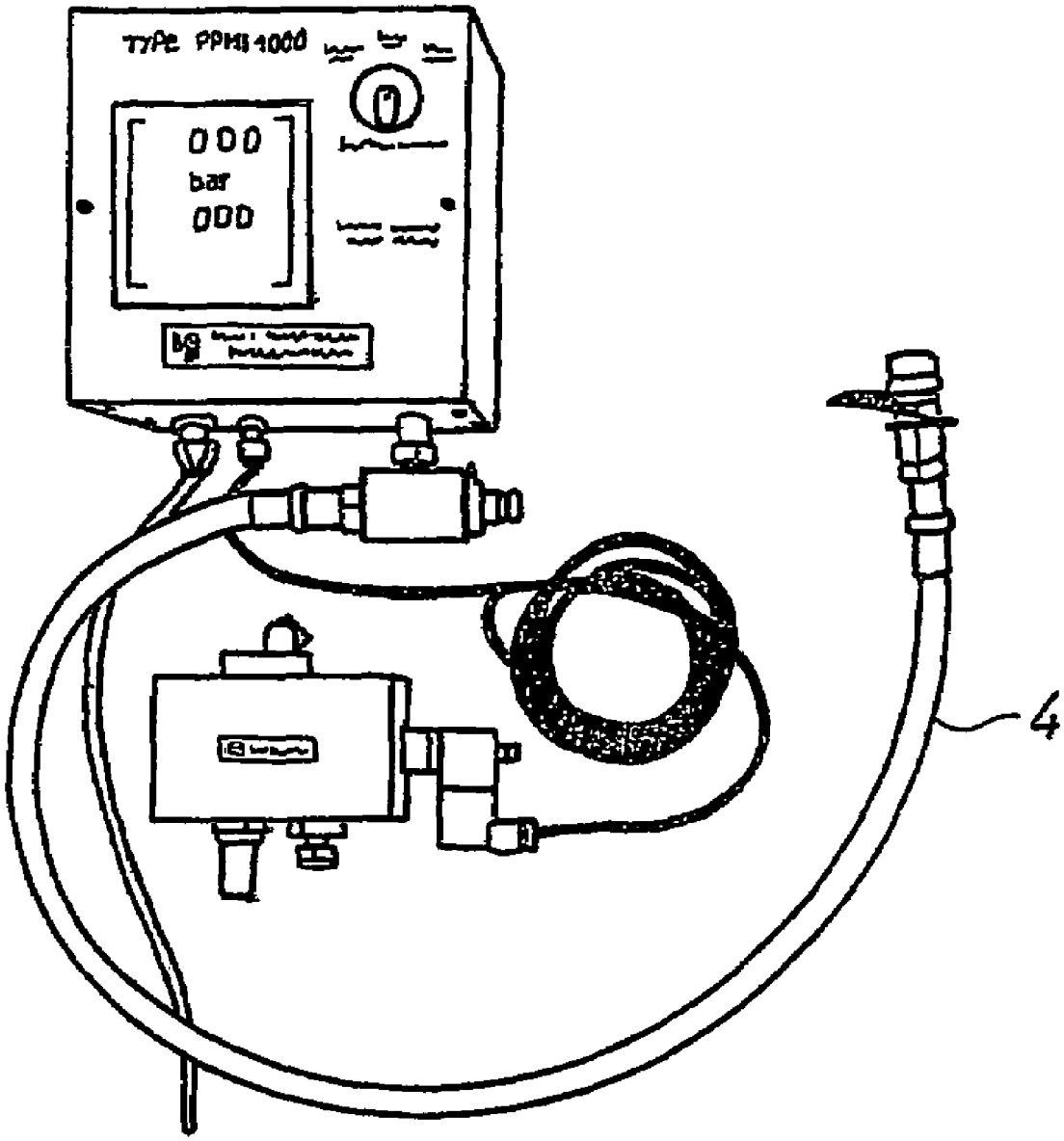
FIG. 4 shows an adapter unit to be arranged on conventional equipment for testing conventional fuel injection valves.
Figure 7:
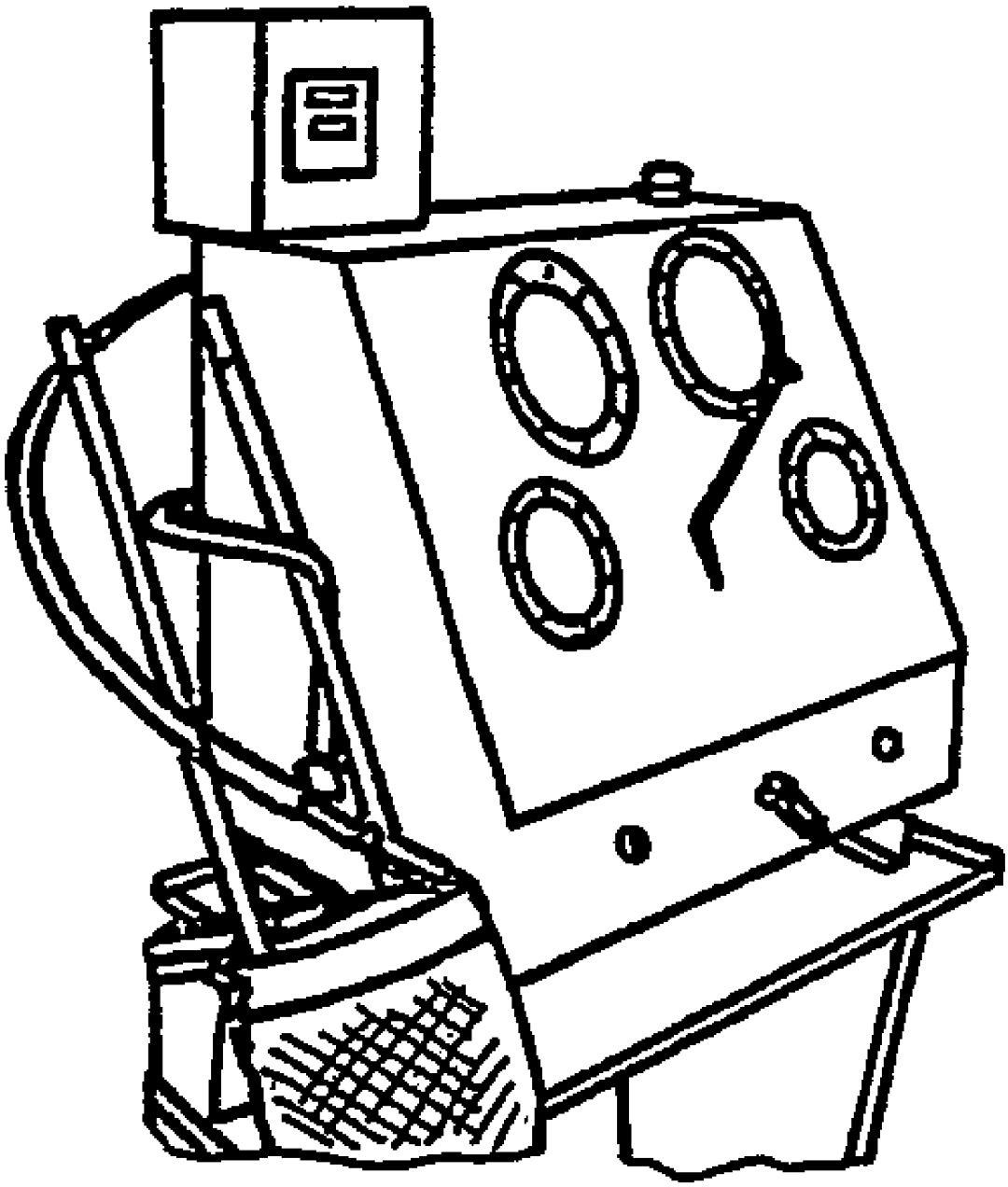
FIG. 7 illustrates conventional test equipment on which an adapter unit according to the invention is mounted.

In addition to the measuring equipment shown in FIG. 3, the applicant has developed a separate electronic adapter unit, which can be mounted on the conventional measuring equipment, confer FIG. 7. As a result the user need not purchase an entirely new measuring equipment when putting the new injection valves into operation. The electronic unit shown in FIG. 4 is mounted by removing the back plate on the conventional measuring equipment and mounting the electronic unit on top of the conventional measuring equipment. The back plate is then remounted. Furthermore a pressure gauge is inserted in the pipe for supplying oil. The pressure gauge performs a continuous sampling of the oil pressure, but only shows the pressure on a display at the moment when a pressure drop occurs. At the same time a signal is transmitted to a magnetic valve inserted in the compressed air pipe to the oil pump, said signal ensuring that the compressed air supply to the oil pump is cut off.

In the latter case the novel feature is thus that a pressure gauge, an air supply block and electronics are combined into a unique product. The novel feature is the functionality of "pressure gauge air supply block electronics" in connection with traditional testing of fuel valves.

As for traditional devices it applies that they are still able to generate the high internal pressure, which previously was used in connection with the carburetion test. It may still be attempted to transfer this pressure to the valve 1, but at the moment when the device records the pressure drop which occurs in connection with the initial opening of the slide valve of the valve 1 (the rattling begins), the air supply is cut off and the test is aborted. In other words, the traditional carburetion test need not be carried out.

The invention claimed is:

1. Method for testing a fuel injection valve (1) for a comparatively large diesel engine, by supplying pressurised oil to the inlet side of the valve (1), by which method the oil pressure on the inlet side gradually increases while being recorded, characterised in that the pressure increase is electronically momentarily interrupted at the moment when the opening pressure of the valve (1) is exceeded, corresponding to the pressure on the inlet side dropping, a compressed air supply for providing the oil pressure on the inlet side being electronically momentarily interrupted at that moment, whereafter the opening pressure is used to decide whether the injection valve in its present state is suitable for use in the engine.

* * * * *